US005823718A

United States Patent [19]

Du Plessis

[11] Patent Number: 5,823,718

[45] Date of Patent: Oct. 20, 1998

[54] PILLAR BAG

[75] Inventor: Joseph A. Du Plessis, Centurion, South Africa

[73] Assignee: Alnet (Proprietary) Limited, South Africa

[21] Appl. No.: 790,551

[22] Filed: Jan. 30, 1997

[30] Foreign Application Priority Data

Jul. 25, 1996 [ZA] South Africa ..... 96/6308

[51] Int. Cl.[6] ..... E21D 15/00; E21D 11/00

[52] U.S. Cl. ..... 405/288; 405/290; 405/233

[58] Field of Search ..... 405/289, 288, 405/290, 303, 229, 230, 232, 233

[56] References Cited

U.S. PATENT DOCUMENTS

| | | | |
|---|---|---|---|
| 3,695,582 | 10/1972 | Clay | 405/289 X |
| 3,984,989 | 10/1976 | Turzillo | 405/233 X |
| 4,983,077 | 1/1991 | Sorge et al. | 405/229 X |
| 5,308,196 | 5/1994 | Frederick | 405/289 X |

FOREIGN PATENT DOCUMENTS

| | | | |
|---|---|---|---|
| 81/5868 | 8/1981 | South Africa . | |
| 85/7581 | 6/1985 | South Africa . | |
| 86/7580 | 10/1986 | South Africa . | |
| 86/7581 | 10/1986 | South Africa . | |
| 0608944 | 5/1978 | U.S.S.R. | 405/289 |
| 0608956 | 5/1978 | U.S.S.R. | 405/289 |
| 0685832 | 9/1979 | U.S.S.R. | 405/289 |
| 1006762 | 3/1983 | U.S.S.R. | 405/289 |
| 1027405 | 7/1983 | U.S.S.R. | 405/289 |
| 2109038 | 5/1983 | United Kingdom | 405/289 |

*Primary Examiner*—Dennis L. Taylor
*Attorney, Agent, or Firm*—Locke Reynolds

[57] ABSTRACT

A pillar bag which is made from a synthetic fabric which is folded, at vertically spaced intervals, to form a number of sheaths, with each sheath housing a reinforcing ring.

13 Claims, 5 Drawing Sheets

PILLAR BAG

BACKGROUND OF THE INVENTION

This invention relates to a pillar bag of the kind used in an underground excavation in order to provide support between a hanging and foot wall. The bag is mounted to suitable supporting structure and is then filled with a cementitious or other settable material which is allowed to harden.

It is desirable with this type of bag to make use of some form of reinforcing to provide hoop strength for the bag. It is also desirable to protect the reinforcing from the effects of blasting which can occur during mining operations.

SUMMARY OF THE INVENTION

The invention provides a pillar bag which is made from a suitable fabric and which includes at least one reinforcing ring which is formed from at least one closed loop of elongate material.

The closed loop may be formed from a flexible material such as a rope which may be spliced onto itself, from a hollow core rope or braid which is inserted into itself, from an elongate steel member, which may for example be round bar or flat bar, closed and secured eg by welding onto itself, or in any other appropriate way.

The closed loop of elongate material may be located in a preformed sheath which is attached to the fabric. In order to protect the loop from the effects of blasting or any other harmful external cause it is desirable to locate the loop, and hence the sheath, inside the bag.

If however the loop is made from steel or any other material which may resist the effects of blasting then it is possible to attach the sheath to the outside of the bag.

The sheath may be formed from any appropriate fabric or material which is attached for example by stitching to the bag.

In a different form of the invention the closed loop of elongate material is enclosed in a sheath which is formed from the fabric from which the bag is made. The sheath may be defined by folding the bag fabric appropriately, locating the loop between two opposed sections of the fold, and stitching or otherwise securing the sections to one another.

With this form of the invention the sheath may be formed inside or outside the bag.

The bag may include a plurality of the loops at spaced intervals from one another along the height of the bag. The number of loops, their spacing, the material from which they are made and the strength of the loops are determined substantially empirically, through trial and experiment, according to design requirements.

The invention also provides a pillar bag which is made from a suitable fabric and which includes at least one sheath which is formed by suitably folding the fabric and at least one reinforcing ring located in the sheath.

The sheath may be positioned so that it is inside the bag or outside the bag, in use.

The bag may include a plurality of the sheaths at spaced intervals from one another with each sheath respectively housing a suitable reinforcing ring.

The reinforcing ring may be flexible and may be made from any suitable material such as nylon or polypropylene or it may be made from a metallic material such as steel in which event it could for example comprise round bar or flat bar.

Depending on the material which is to be placed in the bag the material from which the bag is made could be water pervious, to allow water to drain from the bag, or impervious. In the latter case the bag could be filled with a settable grout, which could include a gelling agent, to reduce water seepage. The bag material may be synthetic eg knitted polyethylene or polypropylene fibre.

BRIEF DESCRIPTION OF THE DRAWINGS

The invention is further described by way of examples with reference to the accompanying drawings in which.

DESCRIPTION OF PREFERRED EMBODIMENTS

Figure 1:
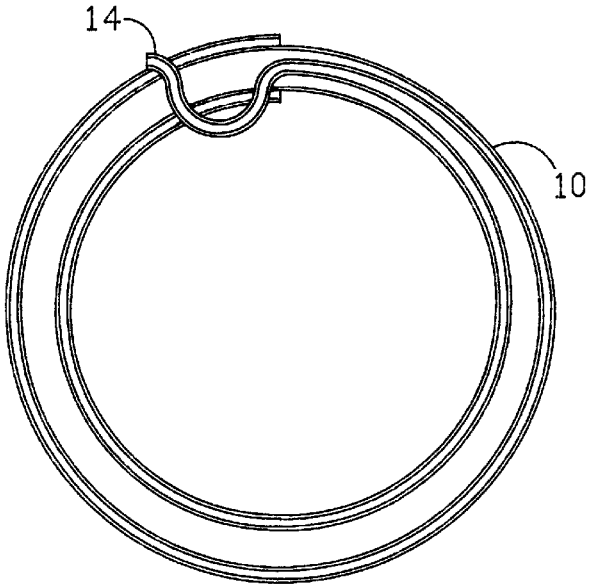
FIG. 1 illustrates a reinforcing ring, according to one form of the invention, for use in the pillar bag of the invention.
Figure 2:
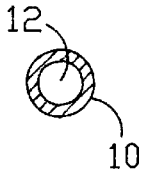
FIG. 2 is a cross-section through the material from which the reinforcing ring of FIG. 1 is made.

FIGS. 1 and 2 of the accompanying drawings illustrate a braided polypropylene rope 10 which has a hollow core 12 and which is threaded into itself for a complete loop, as shown in FIG. 1. The leading end 14 of the rope is then threaded transversely through the rope. This simple form of construction provides a closed loop of significant strength. In FIG. 1 the proportions of the loop have been distorted only for the sake of clarity of illustration for, in practice, the ratio of the diameter of the loop to the diameter of the rope is substantially greater than what is illustrated.

Figure 3:
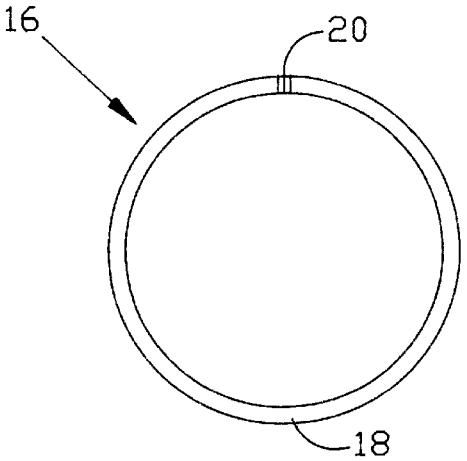
FIGS. 3 and 4 respectively illustrate alternative reinforcing rings for use in the pillar bag of the invention.

FIG. 3 illustrates a different way of making a reinforcing ring 16 wherein a flexible rope 18 is fashioned into a closed loop by means of a splice 20 at abutting ends of the rope.

Figure 4:
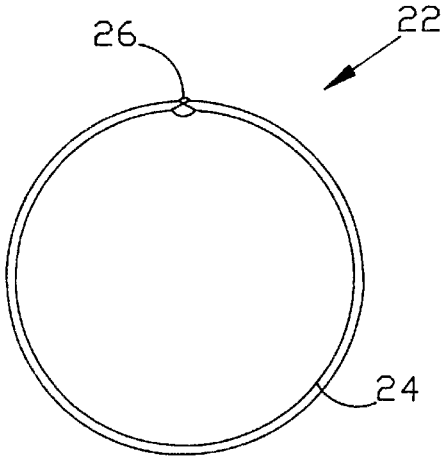

FIG. 4 illustrates a third form of reinforcing ring 22 which consists of a length 24 of steel round bar or flat bar shaped into a ring, with abutting ends welded together at a location 26.

Figure 5:
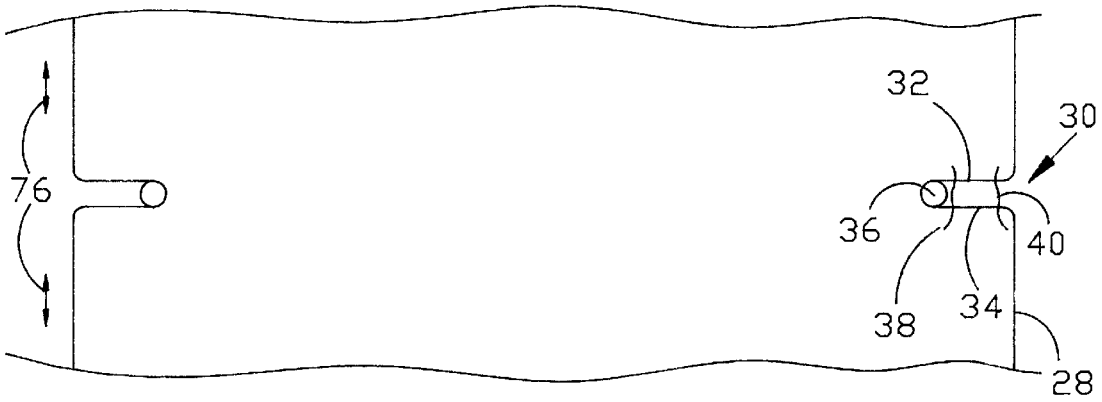
FIG. 5 is a cross-sectional view through a portion of a pillar bag according to one form of the invention.

FIG. 5 depicts a cross-section through a pillar bag 28 according to a first form of the invention. Before upper and lower ends are fixed to the bag, the fabric of the bag is folded inwardly at a number of locations 30, only one of which is shown in the drawing. In this way two opposing fabric sections 32 and 34 are formed and a reinforcing ring 36 which may be of the kind shown in any one of FIGS. 1, 3 and 4, is placed between the two sections 32 and 34. These sections are then sewed to one another along lines 38 and 40.

Figure 6:
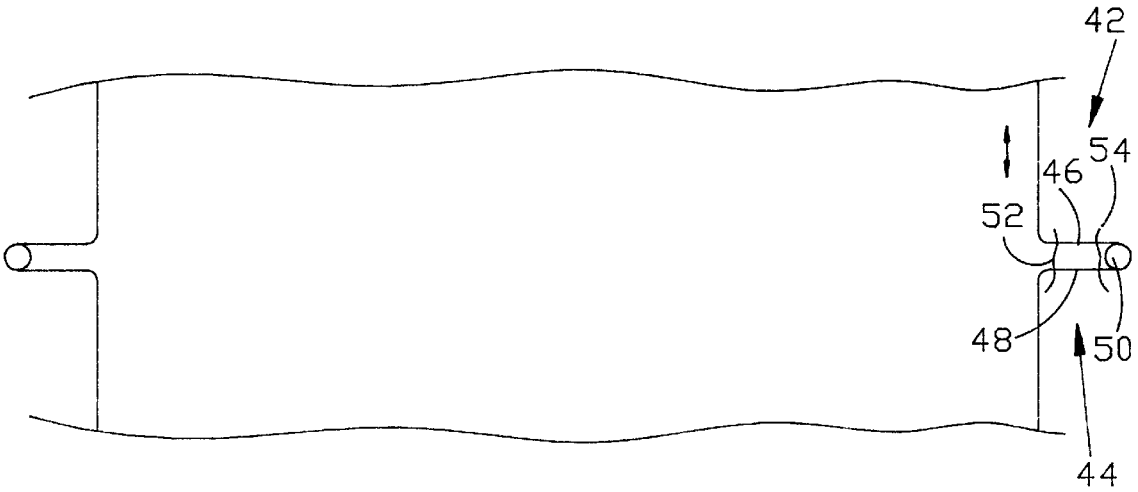
FIG. 6 is a cross-sectional view through a portion of a pillar bag according to another form of the invention.

In the pillar bag 42 shown in FIG. 6 a similar technique is adopted but, in this case, the sheath 44 is formed by folding the bag fabric upwardly to form fold sections 46 and 48. A reinforcing ring 50 is positioned between the folded fabric sections which are then stitched to each other along lines 52 and 54.

Figure 9:
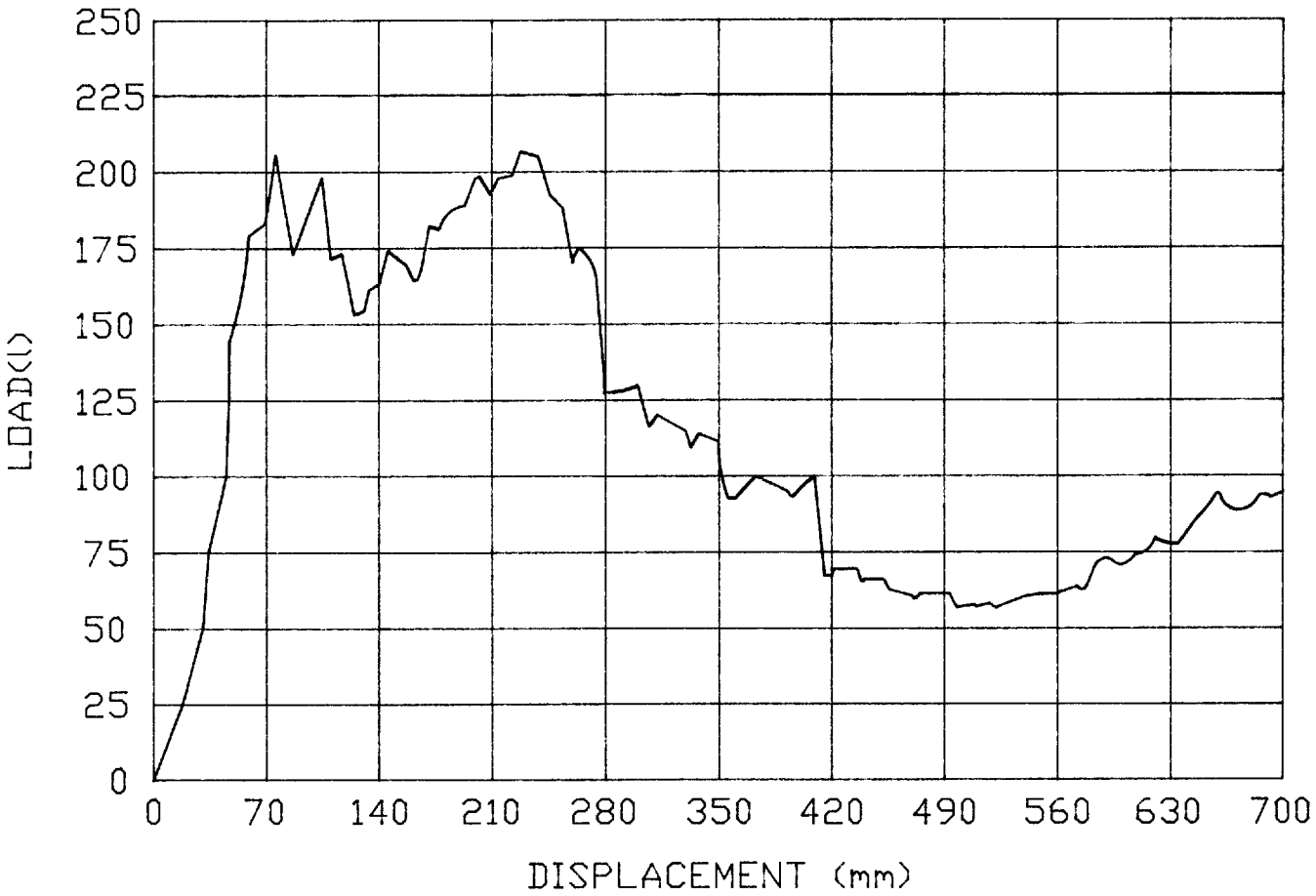
FIGS. 9 and 10 are graphs of load vs displacement measured under test conditions for pillar bags of the kind shown in FIGS. 5 and 6 respectively.
Figure 10:
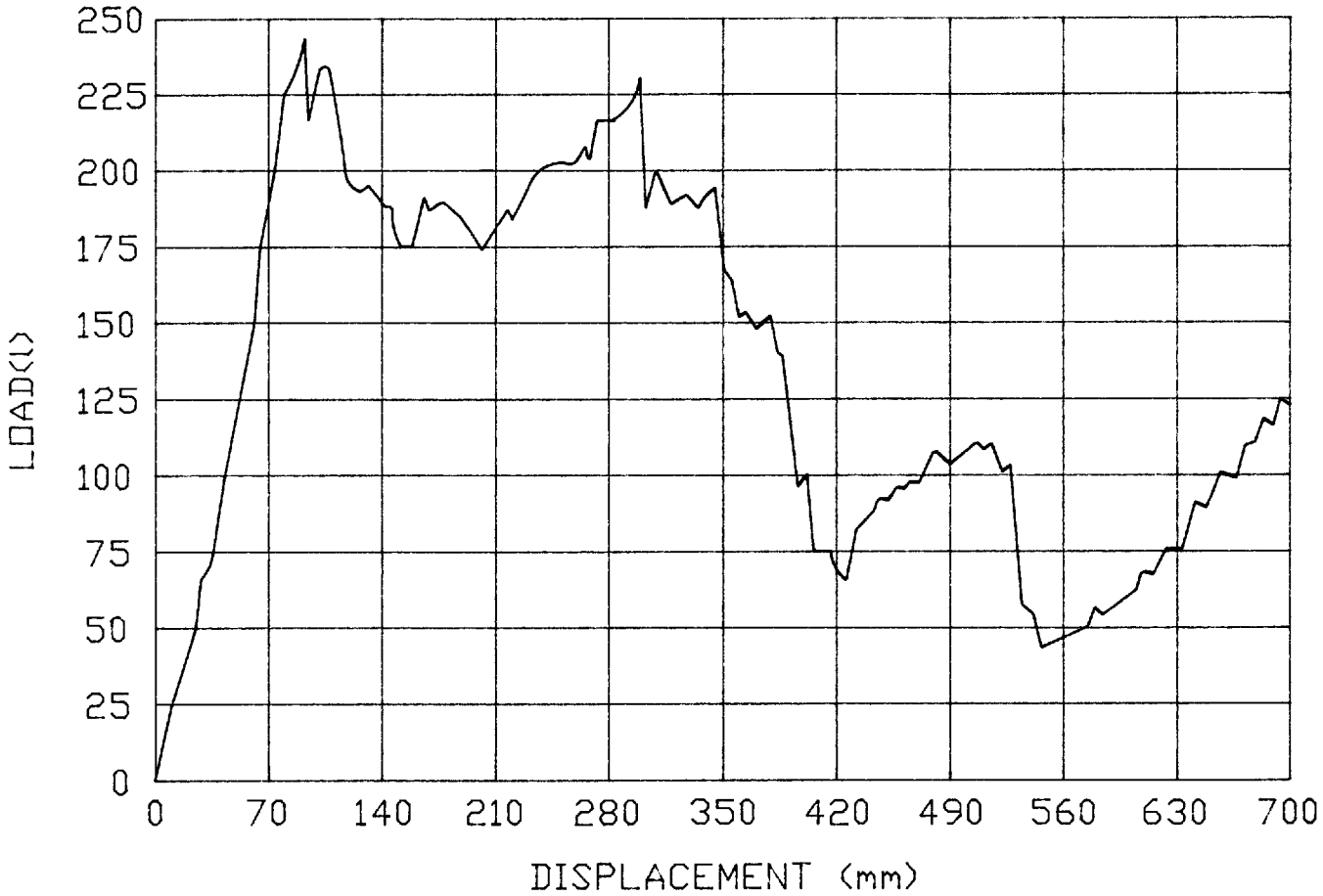

FIGS. 9 and 10 show graphs of load vs displacement for pillar bags 28 and 42 of the kind shown in FIGS. 5 and 6 respectively. A high initial load bearing capability of at least 200 tons is rapidly achieved with a relatively small displacement, of the order of 70 mm, and thereafter the bags have significant load bearing ratings while yielding up to about 280 mm in the former case and 350 mm in the latter case.

Figure 7:
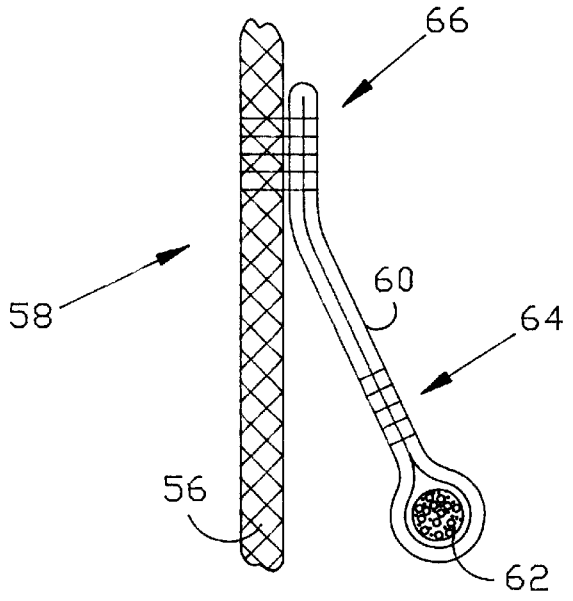
FIG. 7 illustrates a side wall of a pillar bag according to another form of the invention.

FIG. 7 illustrates a wall 56 of a pillar bag 58 to which is attached, on an inner or outer surface as the case may be, a preformed sheath 60 which contains a reinforcing ring 62. In this case the sheath 60 is formed by overlapping lengths of material and the ring 62 is held in position by means of stitching 64. Subsequently, by means of stitching 66, the sheath is attached to the fabric of the bag.

With the arrangement shown in FIG. 5 it is possible to use reinforcing rings which are made from relatively soft material such as polypropylene, nylon or the like. When the bag is filled with a slurry, eg a slimes mixture, or a cementitious mixture, the reinforcing rings 36 are embedded in the mixture and consequently are protected from the effects of blasting which can take place in underground conditions and which otherwise could possibly damage the reinforcing rings. The integrity of the bag is therefore largely ensured.

With the FIG. 6 arrangement the reinforcing ring 50 will normally be of steel for it is on an exposed outer side of the bag once the bag has been filled with a cementitious mix. The steel, which could be of round bar or flat bar, is able to withstand the effects of blasting.

With the FIG. 7 arrangement the reinforcing ring 62 may be of any of the types shown in FIGS. 1, 3 and 4 or, in fact, be formed in any appropriate way by means of a length of elongate material which is closed on itself. Again, as has been noted, if the ring 62 is of a relatively soft material it is located inside the bag while, if the ring 62 is made from a material such as steel which can withstand the effects of blasting, it is possible to position the sheath and hence the ring on the outer side of the bag.

Figure 8:
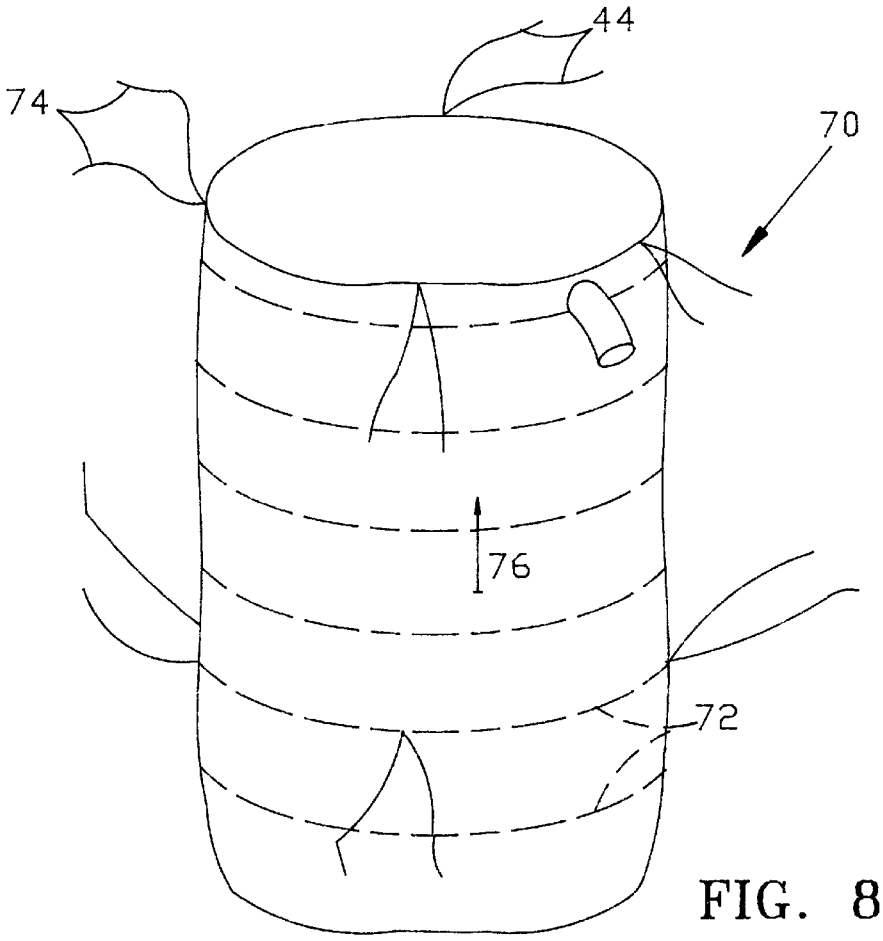
FIG. 8 depicts a pillar bag with an optional feature according to the invention.

FIG. 8 shows a complete piller bag 70 which has a number of reinforcing rings 72 at spaced intervals along its length. The bag has ties 74 fixed to it at appropriate points to facilitate erection of the bag and, more particularly, to tie the bag to supporting structures under adverse, eg sloping, conditions.

Preferably the bag is made from material which is formed with integral reinforcement which extends longitudinally in the vertical direction 76 of the bag, as depicted by means of arrows in FIG. 5. Thus the bag is reinforced both in the vertical sense by means of the reinforcement 76, and in a hoop manner by means of the reinforcing rings.

It is to be noted that the number and spacing and strength of the reinforcing rings are largely determined by the particular application in mind.

I claim:

1. A pillar bag for defining the periphery of a vertical support to be cast, in situ, of a settable material filling the pillar bag to form a monolithic structure, the pillar bag comprising a side wall of porous circumscribing fabric material, having upper and lower ends, a plurality of sheaths around the side wall at fixed locations spaced from each other between the upper and lower ends, and a like plurality of reinforcing rings, each ring being formed from at least one closed loop of elongate material, each ring being located within one of the sheaths to provide the side wall with enhanced hoop strength.

2. A pillar bag according to claim 1 wherein each sheath comprises a separate strip of elongated material having parallel edges joined together to form a pocket for containing one of the rings, the lower edges of each sheath being secured to the side wall at a selected distance from the side wall upper and lower ends and spaced from any other sheath.

3. A pillar bag according to claim 1 wherein each closed loop comprises a rope which is spliced onto itself.

4. A pillar bag according to claim 1 wherein each closed loop comprises a braid which is inserted into itself.

5. A pillar bag according to claim 3 wherein each closed rope comprises a hollow core rope.

6. A pillar bag according to claim 1 wherein each closed loop is made from an elongate steel member which is closed in a loop and secured onto itself.

7. A pillar bag according to claim 1 wherein each sheath comprises a circumferential fold integrally formed of the side wall fabric, the fold having an upper edge and a lower edge, the upper and lower edges being secured to each other.

8. A pillar bag according to claim 3 wherein each sheath is located on what, in use, is an inner side of the wall.

9. A pillar bag according to claim 7 wherein the circumferential fold extends inward from the sidewall.

10. A pillar bag according to claim 3 wherein each sheath is located on what, in use, is an outer side of the wall.

11. A pillar bag according to claim 7 wherein each circumferential fold extends outward from the sidewall.

12. A pillar bag for defining the periphery of a vertical support to be cast, in situ, of a cementitious material filling the pillar bag to form a monolithic structure, the pillar bag comprising a side wall of porous circumscribing fabric material, having upper and lower ends, a plurality of sheaths around the side wall at fixed locations spaced from each other between the upper and lower ends, and a like plurality of reinforcing rings, each ring being formed from at least one closed loop of elongate material, each ring being located within one of the sheaths to provide the side wall with enhanced hoop strength, each sheath being comprising a circumferential fold integrally formed of the side wall fabric and extending inwardly from the side wall so that each ring is positioned within and protected by the cementitious material filling the pillar bag.

13. A method of making a pillar bag which comprises the steps of forming a circumferential side wall from a flexible fabric, forming opposed upper and lower ends to the wall and, at each of a plurality of locations which are spaced from one another between the said upper and lower ends, forming a respective sheath by folding the fabric of the wall to form two opposed sections of the fabric, locating a closed reinforcing loop between the two opposed fabric sections, and securing the sections to each other thereby to enclose the loop between the sections.

* * * * *